United States Patent [19]

Shen et al.

[11] Patent Number: 4,912,428

[45] Date of Patent: Mar. 27, 1990

[54] SIMPLIFIED SLOTLESS CONTACTS FOR COAXIAL LINE CONNECTORS

[75] Inventors: Zhi-Yuan Shen, Ossining; Andrew W. Laundrie, Tarrytown, both of N.Y.

[73] Assignee: Hypres Incorporated, Elmsford, N.Y.

[21] Appl. No.: 203,115

[22] Filed: Jun. 7, 1988

[51] Int. Cl.[4] ..... H01P 1/04

[52] U.S. Cl. ..... 333/260; 439/578; 439/825

[58] Field of Search ..... 333/260; 439/578, 825

[56] References Cited

U.S. PATENT DOCUMENTS

| | | | |
|---|---|---|---|
| 2,966,645 | 12/1960 | Bird et al. | 439/578 X |
| 3,394,341 | 7/1968 | Venn | 439/825 X |
| 3,783,434 | 1/1974 | Ransford, III | 439/578 X |
| 4,468,083 | 8/1984 | Lee et al. | 439/825 X |
| 4,687,279 | 8/1987 | Holland et al. | 439/578 |

OTHER PUBLICATIONS

Weinschel Engineering "Technical Information—Connectors" pp. 216 and 218.

Amphenol precision coaxial connectors APC—7 Airline Assembles and Accessories p. 69.

*Primary Examiner*—Paul Gensler

*Attorney, Agent, or Firm*—Kenyon & Kenyon

[57] ABSTRACT

A connector provides electrical and mechanical connection between the inner conductors of a pair of coaxial lines. The connector avoids the use of a slotted female conductor by either providing a slotted male conductor or by providing slotless conductors. The configuration allows a two layer construction of the connector so that the construction is simple and so that signals of higher frequency can be transmitted without severe signal degradation. In addition, the connector provides an electrical contact which is close to the interface between the two inner conductors so that the resonant frequency of the connector is sufficiently high as to avoid degradation of the electrical performance of the connector.

7 Claims, 6 Drawing Sheets

SIMPLIFIED SLOTLESS CONTACTS FOR COAXIAL LINE CONNECTORS

BACKGROUND OF THE INVENTION

1. Field of the Invention

This invention is related to a connector for coaxial lines. In particular, this invention is related to a connector which provides repeatable and secure contact between coaxial lines without utilizing a slotted female conductor.

2. Related Art

Coaxial line connectors are widely used to interface electrical systems. Such connectors must make durable mechanical contacts that are repeatable, provide good electrical performance and are easy to fabricate.

In a coaxial line a current is carried through both an inner conductor and an outer conductor. Generally, the inner conductor has a greater current density. The connector provides contact between the coaxial inner conductors and outer conductors that correspond to those of the two coaxial lines. However, the connector portion providing contact between the inner conductors of two coaxial lines is more critical than the connector portion providing contact between the outer conductors because of the differences in current density between the inner and outer conductors of the lines. It is therefore desirable to provide a secure connection between the two inner conductors of two coaxial lines.

In one known connector configuration, a coaxial connector has a female inner conductor connected to an end of the inner conductor of a first coaxial line and a male inner conductor connected to the end of the inner conductor of a second coaxial line whereby the male and female inner conductors are joined to form the connection between the inner conductors of the first and second coaxial line. A typical structure of such a male/female conductor configuration is illustrated in FIG. 1.

In FIG. 1 a female conductor 10 is connected to an inner conductor 12 of a first coaxial cable. The female conductor has at least one slot 13. A second inner conductor 16 associated with the second coaxial cable has a male conductor 14 connected to the inner conductor. As male conductor 14 is inserted into female conductor 10 the slot 13 provides the capability for allowing the female conductor to be flexible enough to receive the male conductor 14. In order to provide a secure contact, the known configuration utilizes a female conductor that has two or four slots. The slots provide an elastic or pliable characteristic to the female conductor so that the conductor makes good contact with the male conductor upon receiving the male conductor pin.

The electrical performance of such a connector as illustrated in FIG. 1 is degraded by the slots, especially at high frequency. The reason for this performance degradation is that the slots are exposed in radio frequency ("RF") fields and generate undesirable modes such as $TE_{n1}$ for two slots or $TE_{n2}$ for four slots. These undesirable high modes act like parasites to the operating TEM mode causing frequency sensitive reflections and high VSWR.

A solution to the problem caused by the slots has been proposed. Such a solution has been referred to as a "slotless contact". The structure of this contact is illustrated in FIG. 2. In this figure the inner conductor connector is a three-layer structure. A male conductor 22 of the inner conductor 26 of a first coaxial cable is captured by a female conductor 20 which has at least one slot. This configuration, however, includes a construction which prevents the slot or slots from being exposed in RF fields. In order to do this, a hollow cylindrical inner conductor member 24 is provided as a shielding or a shelter for the female conductor. Therefore, the term "slotless contact" is a misnomer as the female conductor still has slots, the difference is that the slots are shielded from the RF field so that degradation caused by the slots is reduced and the electrical performance is enhanced. However, there is a disadvantage associated with this approach. It involves a complex three layer structure which is difficult to fabricate and to assemble. It is difficult to construct such a three layer connector for use in a very high frequency environment, for instance a connector operable over a range of from DC to 100 GHZ, because the outer diameter of the inner conductor for such an operating range can only be about 0.5 millimeters. It is virtually impossible to make the inner conductor of such a size in a three-layer structure. Another problem with this structure is that there is a distance between the mechanical contacts at the tip of the ends of the female conductor which receive the male conductor and the electrical interface of the two coaxial inner conductors where the gap is caused by the configuration of the shielding conductor 24. Undesirable resonance will occur at certain frequencies thereby further degrading the performance of the connector.

Another known connector utilizes a non-mating connector shown in FIG. 7. Non-mating contacts 71 are disposed within hollow cylinders 72. The contact between cylindrical contact 72 and an inserted contact 71 is a regular sliding contact which has small gaps between the cylindrical and inserted contacts. Springs 73 provide the necessary force for bringing the sliding contact 71 of the respective coaxial lines together.

SUMMARY OF THE INVENTION

This invention provides a connector for coaxial lines which does not include a slotted female inner conductor for connecting inner conductors for two coaxial lines. The connector of this invention provides repeatable, durable and secure mechanical and electrical contacts between the inner conductors of the two coaxial lines. The connector has good electrical performance characteristics at high frequencies of operation.

According to a first embodiment of the invention, a female inner conductor is provided without slots while a male inner conductor, to be inserted into the female inner conductor, is provided with slots. The slots allow the male conductor to be constructed to be slightly larger than the female conductor in its rest state and the male conductor can be compressed upon entering the female conductor so as to establish a secure contact with the inner wall of the female conductor.

According to a second embodiment of the invention a slotless conductor is provided in which a male conductor includes a barrel-shaped drum portion which is inserted into a female inner conductor and caused to be deformed by pressures acting upon the drum by the physical connection of the two conductors. The deformation of the barrel-shaped drum causes a secure contact with the inner wall of the female inner conductor.

According to yet another embodiment of the invention a slotless, non-mating connector is provided in which two coaxial lines are both connected to barrel-shaped or drum shaped hollow bodies and the bodies are joined together and slightly deformed by the joining pressure so as to provide a secure and repeatable contact.

BRIEF DESCRIPTION OF THE DRAWINGS

The present invention will be described in greater detail below with reference to the drawings in which.

DETAILED DESCRIPTION

In order to accomplish the desired repeatable, durable and secure contact having high quality electrical performance with easy fabrication, this invention presents a simple structure where the distance between mechanical interface and electrical contact is as short as possible in order to avoid undesirable resonance. The connector is either slotless or provides slots shielded from RF fields in order to avoid undesirable high mode excitation.

Figure 1:
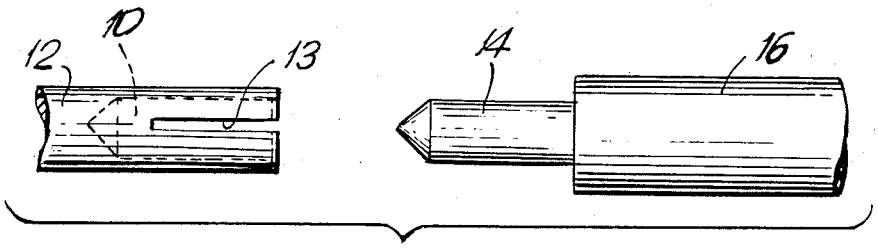
PRIOR ART FIG. 1
FIG. 1 illustrates a known coaxial connector utilizing a slotted female conductor.
Figure 2:
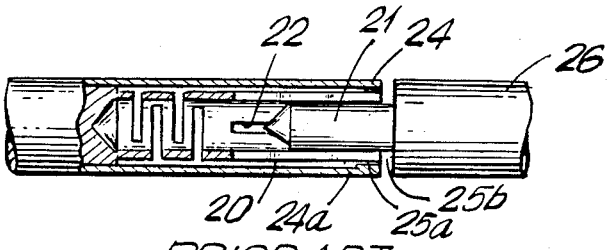
PRIOR ART FIG. 2
FIG. 2 illustrates a known coaxial connector using a slotted female conductor including a shielding sleeve.
Figure 3A:
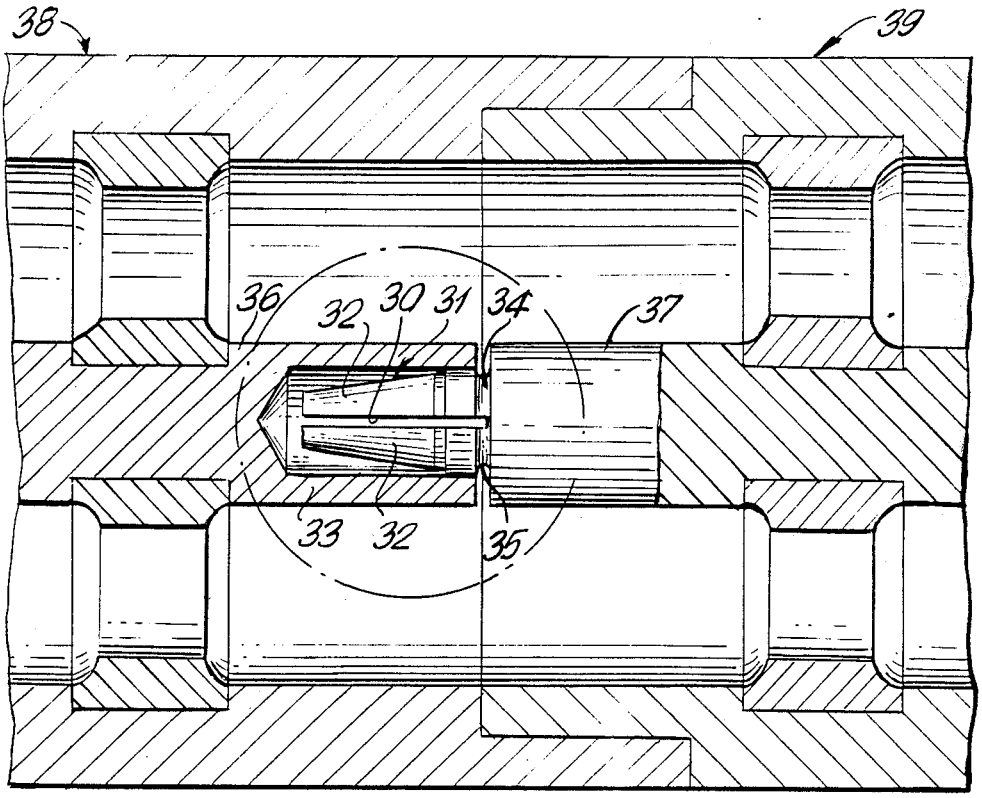
FIG. 3*a* illustrates a plan view of a first embodiment of the invention in which a male slotted conductor is inserted into a female slotless conductor for providing a connection between two coaxial lines.

FIG. 3*a* illustrates a first embodiment of the invention. In the encircled region of FIG. 3*a* the connection between the inner conductors of coaxial cables 38 and 39 is illustrated. A male inner conductor pin 31 has a base 34 which is connected to an inner conductor 37 of coaxial line 39. As shown in FIG. 3*a*, the male pin 31 is inserted in a hollow cylindrical region of female conductor 33 of the inner conductor 36 of coaxial line 38. The male conductor pin 31, has at least one slot 30 which produces spring fingers 32 on the male conductor pin 31. These spring fingers 32 are elastic. The spring fingers provide the male conductor pin 31 with pliability so that it can be inserted into the cylindrical region of the female conductor 33. Upon insertion, the spring fingers cause the male conductor to attempt to expand so as to come into secure contact with the inner walls of the female conductor. The female conductor 33 then serves as a shelter for slots on the male conductor, shielding them from the RF fields. Therefore, undesirable high mode excitation problems which are associated with normal slotted connectors are eliminated by shielding using only a two layer structure as opposed to the three layer structure of the known connector illustrated in FIG. 2. The embodiment illustrated in FIG. 3*a* is simpler and it is easier to make than the known three layer connector, especially when making small sized connectors for high frequency applications.

The contact quality and the electrical performance depend upon where the real mechanical contact is located. In the conventional shielded, slotted connector illustrated in FIG. 2, the electrical contact is made at the tip of spring fingers of the female conductor which are formed by the slots. It can be seen from FIG. 2 that the sleeve section 24*a* produces a gap between the electrical contact of the conductors 25*a* and the physical interface of the coaxial lines 25*b*. As the operating frequency increases this gap distance may correspond to a quarter of a wavelength of the operating signal. If this condition arises, an undesirable resonance occurs which is equivalent to creating an open circuit at the interface. The electrical performance of the connector of FIG. 2 is degraded severely at such resonance frequency and in the vicinity of the resonance frequency.

In the connector of the present invention, the slotted male pin 31 is designed to have a small-angle cone shape. This configuration guarantees that the electrical contacts are located close to the interface of the two inner conductors, thereby minimizing the distance between those contacts and the interface to a significant degree. The electrical contacts of the male and female conductors are established at the appropriate physical interface of the coaxial lines. This approach makes the frequency at which resonance will occur much higher than that of the configuration of the known connector of FIG. 2. Therefore, the electrical performance of the connector of the first embodiment of the invention is greatly improved as compared to the known connector.

Figure 3C:
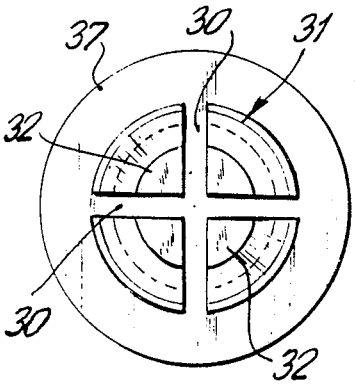
FIGS. 3*b* and 3*c* illustrate details of the male conductor pin of FIG. 3*a*.
Figure 3B:
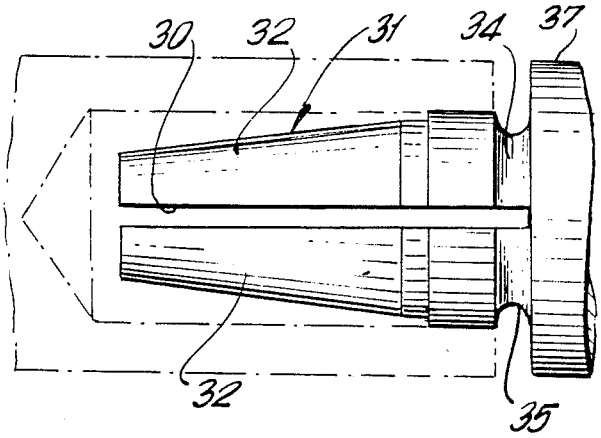

FIG. 3*b* illustrates in greater detail the construction of the male conductor 31. FIG. 3*b* illustrates an enlarged side view of the male conductor 31. The conductor includes slot 30, spring fingers 32 and base 34 attached to the inner conductor of the second coaxial line 39 wherein the base has a circumferential groove 35. A cross section of the male conductor is illustrated in FIG. 3*c* in which slots 30 separate the male conductor into four spring fingers 32. The conductor is made to be slightly larger in its at rest position than the inner hollow cylinder of the female conductor which is to receive the male conductor. As the male conductor is being inserted in the female conductor the slots allow the spring fingers to be compressed towards one another and upon entrance into the female conductor the spring fingers act with a spring reaction force attempting to return to their rest position, thereby causing the male conductor spring fingers to push against the inner wall of the female cylindrical contact. The groove 35 cut around the male pin at its base 34 allows the spring fingers 32 to pivot more easily.

Figure 4:
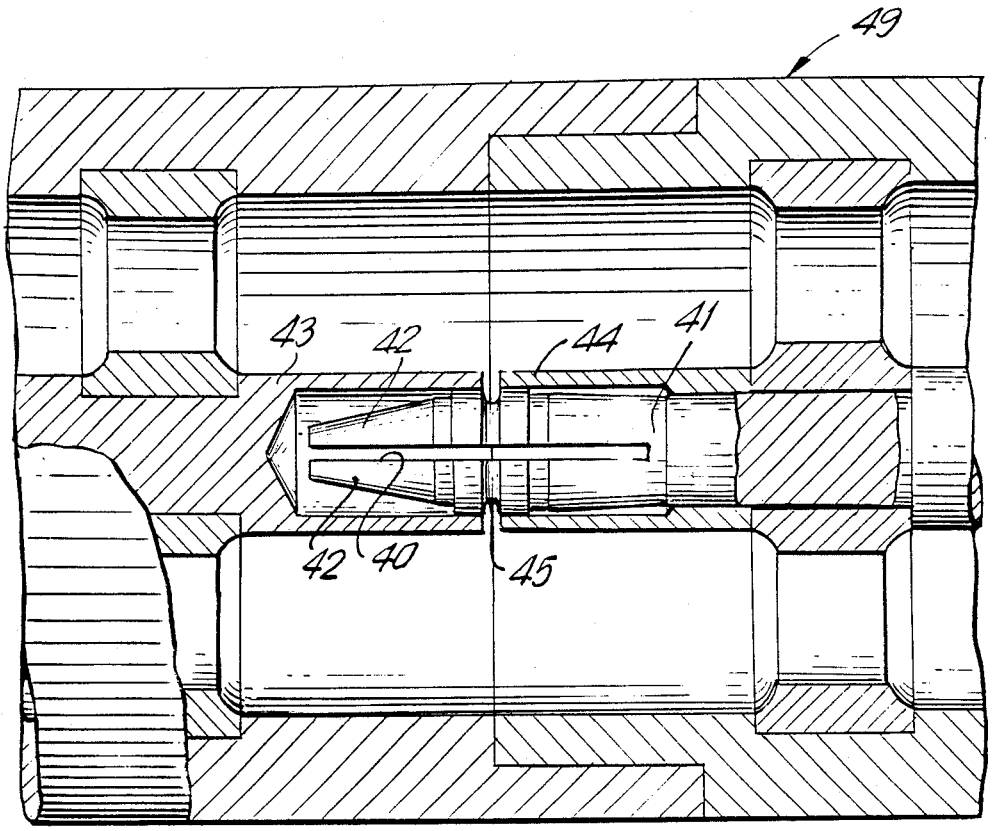
FIG. 4 illustrates a plan view of a second embodiment of the invention utilizing a slotted male conductor.

FIG. 4 illustrates another embodiment of the present invention utilizing the slotted male conductor. The cylindrical female conductor 43 is the same as contact 33 of FIG. 3*a*. The difference between the configurations of FIG. 3*a* and FIG. 4 are differences in the male conductor. In the embodiment illustrated in FIG. 4, male conductor 41 is connected to the inner conductor of second coaxial line 49. Slots 40 on male conductor 41 extend into the inside of cylindrical shelter conductor 44 so that the male conductor 41 has a slot or slots hat extend on both sides of the interface of the two coaxial cables. The result is that the spring fingers 42 are longer than the corresponding spring fingers of the embodiment illustrated in FIG. 3*a*. The spring fingers 42 are designed to have a shuttle shape with two small angles on both sides of the interface of the two coaxial cables. This configuration guarantees secure electrical contact at the approximate interface of the two coaxial lines thereby improving performance. A groove 45 is cut around the male pin 41 near the physical interface of the two inner conductors. The groove 45 assures that the spring fingers 42 of the male conductor 41 pivot at the center and that the spring fingers 42 contact the female conductor 43 and the cylindrical shelter conductor 44 close to the interface. The slots are shielded by the cylindrical female inner conductor 43 and a cylindrical shelter conductor 44 of the male contact Therefore, the RF fields do not see the slots in the male conductor 41 while the longer elastic fingers make the contact between conductors even more secure. The result is a two layer configuration with improved electrical performance and even further improved secure contacts.

Figure 5:
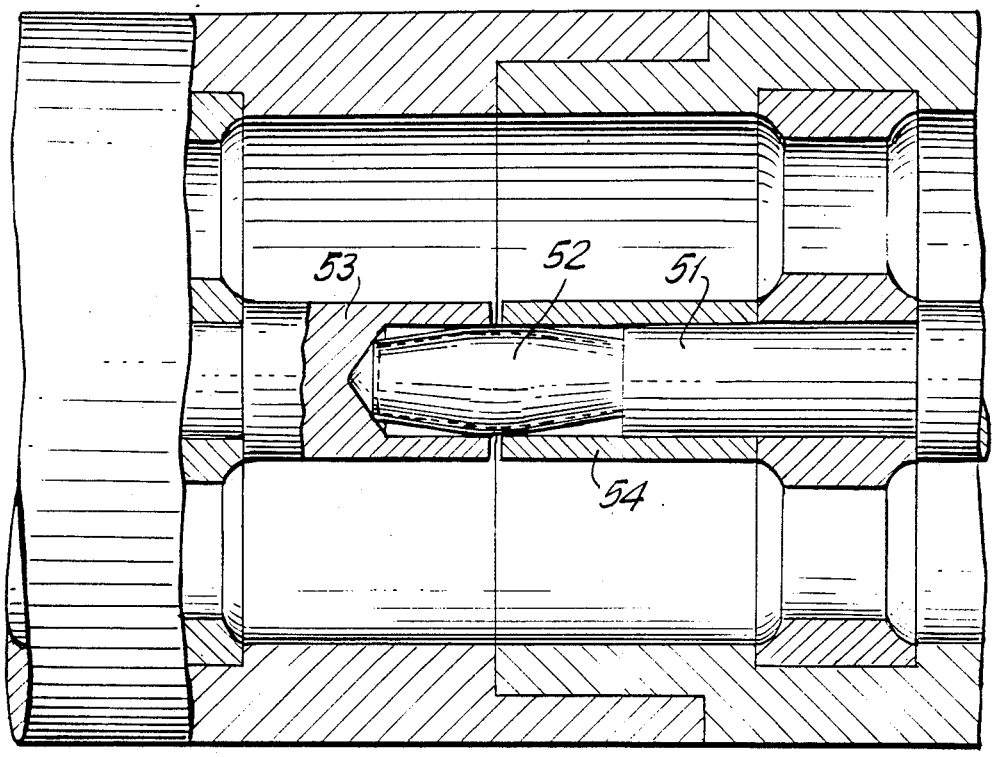
FIG. 5 illustrates a plan view of another embodiment of the invention utilizing a slotless connector to couple two coaxial cables wherein the slotless connector includes a hollow drum male contact.

FIG. 5 illustrates a slotless embodiment of the present invention. The structure is somewhat similar to that illustrated in FIG. 4 except that the elasticity of the male conductor is not provided by slots and spring fingers but rather by a barrel-shaped hollow drum 52 which is attached inside of the male contact 51 and mates with hollow cylindrical female conductor 53. A male cylinder 54 holds the male conductor hollow drum 52. When the male and female contacts mate, that is when female contact 53 and male cylinder 54 are joined to one another, the axial pressures upon the drum 52 from both the male and female sides force the drum to deform in such a way that its length decreases while its diameter increases. This elasticity makes the contacts between the drum 52 and the female conductor 53 secure and it also makes the contacts between the drum 52 and the male cylinder 54 secure. The electrical contact occurs close to or right at the interface of the male and female contacts Therefore, the resonant frequency of the connector will be such as to be high enough to avoid degradation of performance.

Figure 6:
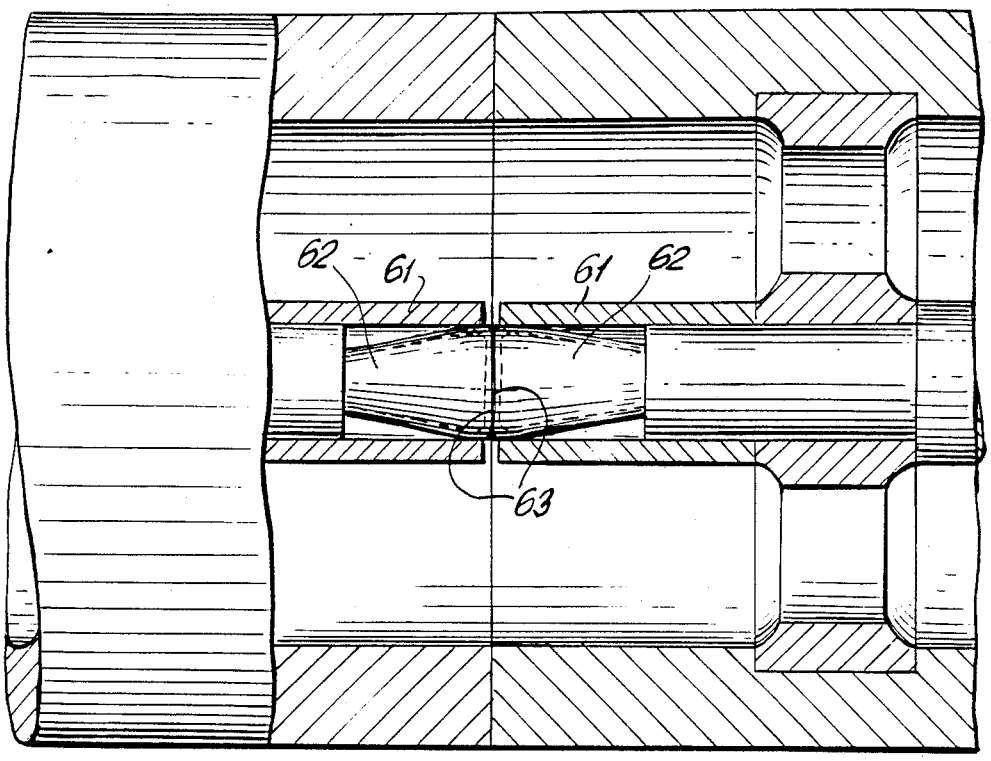
FIG. 6 illustrates a plan view of another embodiment of the invention in which a non-mating, slotless coaxial connector is used to join two coaxial cables.

FIG. 6 illustrates a non-mating, slotless connector as a further embodiment of the present invention. The two sides of the non-mating connector of FIG. 6 have identical structure. The center conductor of each coaxial line includes a hollow cylinder 61. A barrel-shaped hollow drum 62 is disposed inside of each hollow cylinder 61 and has a first flat end at the point to be joined to the other coaxial cable and is tapered to a second end connected to its corresponding coaxial cable. When the connectors are joined at the first flat end of each drum 62, the axial pressure upon the two drums at their physical interface 63 makes each of their lengths shorter and each of their diameters larger. The two flat surfaces will be in secure contact with one another due to an axial pressure brought upon them by bringing the conductors together. At the same time, the increased diameter of each drum 62 makes secure contact with the corresponding cylinder 61. If the elasticity of the drums is not sufficient, it is possible to carve slots in the drums to thereby increase elasticity and further improve the quality of the contacts. The slots are shielded by the respective cylinders. All of the mechanical contacts occur at the interface in this non-mating slotless conductor and therefore the resonance problem associated with known non-mating connectors is avoided.

Figure 7:
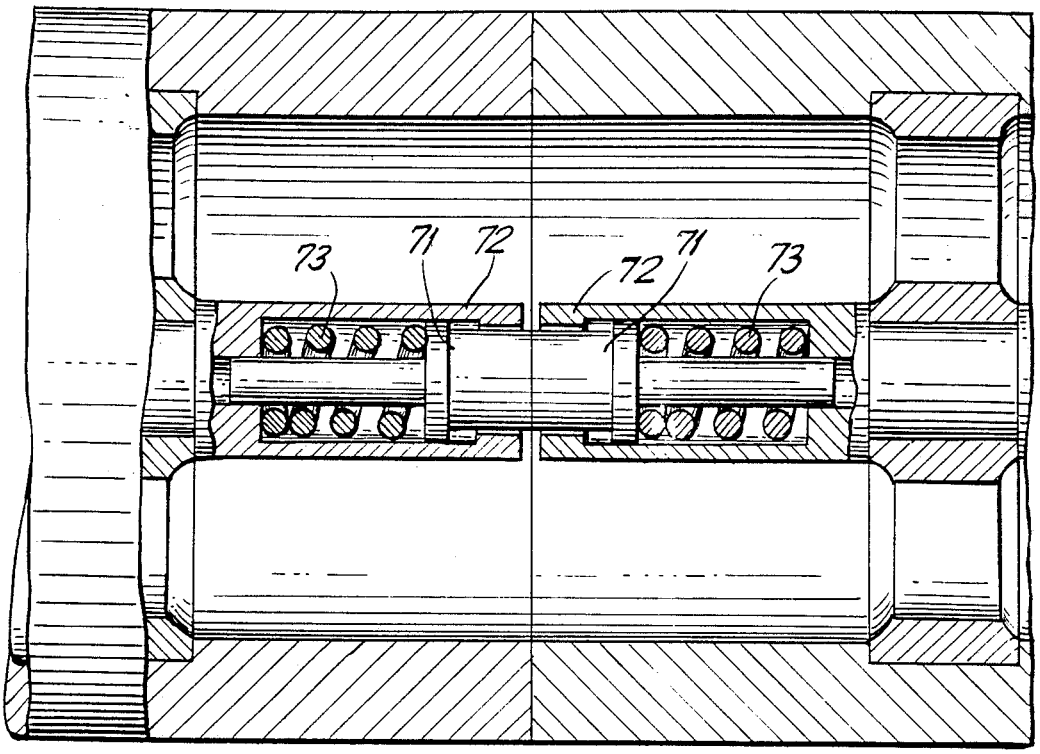
PRIOR ART FIG. 7
FIG. 7 illustrates a plan view of a conventional non-mating connector.

Comparing the non-mating, slotless connector of the present invention with the known connector of FIG. 7 the advantages are obvious especially at high frequency. One advantage is the simplicity of the configuration. The additional spring 73 of FIG. 7 is eliminated. FIG. 6 is a two layer structure so that it can be fabricated in small size for high frequency applications. Another advantage is that the cylindrical contact between cylinder 61 and drum 62 is much more secure than the contact between cylinder 72 and non-mating contact 71 with the regular sliding contacts of FIG. 7 having small gaps between them. In the present invention the gap between cylinder 61 and drum 62 closes due to the radial expansion of the drums. Therefore, better performance can be expected.

The material of the slotted pin and the drum can be any metal or alloy with elasticity and durability. Such materials may include spring steel, beryllium copper or the like. The surface should be plated with high conductivity metal to reduce resistance. The narrow slots on the slotted pin can be fabricated by means of either electrical discharge machining (EDM) or laser cutting.

In the foregoing specification, the invention has been described with reference to specific exemplary embodiments thereof. It will, however, be evident that various modifications and changes may be made thereunto within the broader spirit and scope of the invention as set forth in the appended claims. The specification and drawings are accordingly, to be regarded in an illustrative rather than a restrictive sense.

What is claimed is:

1. In a system of coaxial cables, an apparatus for providing a connection between respective inner conductors of a first and a second coaxial cable comprising:

first means, associated with an inner conductor of a first coaxial cable, for establishing a conductivity path between said inner conductor of said first coaxial cable and an inner conductor of a second coaxial cable; and second means, associated with the inner conductor of said second coaxial cable, for receiving said first means thereby establishing electrical contact with said first means at the interface of the inner conductors of said first and second coaxial cables;

wherein said first means comprises a male conductor comprising a pin with at least one slot and a groove along the circumference of the pin positioned at the physical interface of said first and second means; and said second means comprises a female conductor comprising a hollow cylindrical conductor wherein an outer portion of said male conductor is in electrical contact with an inner wall of said hollow cylindrical conductor.

2. The apparatus of claim 1 wherein a cylindrical tube encompasses a first end of said male conductor at said first coaxial cable and wherein said slot extends across the interface of said first and second coaxial cables and is shielded by said cylindrical tube.

3. In a system of coaxial cables, an apparatus for providing a connection between respective inner conductors of a first and a second coaxial cable comprising:

first means, associated with an inner conductor of a first coaxial cable, for establishing a conductivity path between said inner conductor of said first coaxial cable and an inner conductor of a second coaxial cable; and second means, associated with the inner conductor of said second coaxial cable, for receiving said first means thereby establishing electrical contact with said first means at the interface of the inner conductors of said first and second coaxial cables;

wherein said first means comprises a cylindrical tube connected to said first coaxial cable and a male conductor comprising a barrel-shaped conductor disposed in said cylindrical tube; and wherein said second means comprises a female conductor comprising a hollow cylindrical conductor wherein said barrel-shaped conductor is deformed to provide proper electrical contact with said hollow cylindrical conductor at the interface of said coaxial cables by pressure produced in joining said first and second coaxial cables.

4. A coaxial cable connector comprising:

first means, connected to an inner conductor of a first coaxial cable, for establishing an electrical conductivity path for said inner conductor; and second means, connected to an inner conductor of a second coaxial cable, for receiving said first means within a hollow cylindrical conductor thereby establishing electrical contact with said first means at the interface of the inner conductors of said first and second coaxial cables;

wherein said first means comprises a male conductor comprising a pin with at least one slot and a circumferential groove positioned at the physical interface of the first and second means; and said second means comprises a female conductor comprising a hollow cylindrical conductor wherein an outer portion of said male conductor is in electrical contact with an inner wall of said hollow cylindrical conductor.

5. The connector of claim 4 wherein a cylindrical tube encompasses a first end of said male conductor at said first coaxial cable and wherein said slot extends across the interface of said first and second coaxial cables and is shielded by said cylindrical tube.

6. A coaxial cable connector comprising:

first means, connected to an inner conductor of a first coaxial cable, for establishing an electrical conductivity path for said inner conductor; and second means, connected to an inner conductor of a second coaxial cable, for receiving said first means within a hollow cylindrical conductor thereby establishing electrical contact with said first means at the interface of the inner conductors of said first and second coaxial cables;

wherein said first means comprises a cylindrical tube connected to the first coaxial cable and a male conductor comprising a barrel-shaped conductor disposed in said cylindrical tube and wherein said second means comprises a female conductor comprising a hollow cylindrical conductor wherein said barrel-shaped conductor is deformed to provide proper contact with said hollow cylindrical conductor at the interface of said coaxial cables by pressure produced in joining said first and second coaxial cables.

7. An apparatus for connecting the inner conductors of two coaxial cables comprising:

a male conductor connected at a first end to an inner conductor of a first coaxial cable; and a slotless female conductor connected to an inner conductor of a second coaxial cable and including a hollow cylindrical chamber for receiving said male conductor in said hollow cylindrical chamber wherein an outer portion of said male conductor is in electrical contact with an inner wall of said hollow chamber at the interface of said male conductor and female conductor, wherein said male conductor is tapered from a region at the interface of the male and female conductor in a direction extending into said female conductor and wherein said male conductor comprises a conductor pin having a slot disposed in said pin near to a second end of said pin opposite from said first end and a circumferential groove positioned at the physical interface of the male and female conductors.

* * * * *